US008162195B2

(12) United States Patent
Wu

(10) Patent No.: US 8,162,195 B2
(45) Date of Patent: Apr. 24, 2012

(54) TRIGGER VALVE CONTROLLING DEVICE FOR PNEUMATIC NAIL GUN

(75) Inventor: I-Tsung Wu, Taipei Hsien (TW)

(73) Assignee: De Poan Pneumatic Corp., Taipei Hsien (TW)

( * ) Notice: Subject to any disclaimer, the term of this patent is extended or adjusted under 35 U.S.C. 154(b) by 257 days.

(21) Appl. No.: 12/772,314

(22) Filed: May 3, 2010

(65) Prior Publication Data

US 2011/0266327 A1 Nov. 3, 2011

(51) Int. Cl.
*B25C 1/04* (2006.01)

(52) U.S. Cl. ..... 227/8; 227/130

(58) Field of Classification Search ..... 227/120, 227/130, 8, 10; 123/46 SC
See application file for complete search history.

(56) References Cited

U.S. PATENT DOCUMENTS

| | | | | |
|---|---|---|---|---|
| 5,485,946 | A * | 1/1996 | Jankel | 227/8 |
| 5,785,228 | A * | 7/1998 | Fa et al. | 227/8 |
| 5,911,351 | A | 6/1999 | White | |
| 5,924,621 | A * | 7/1999 | Hung | 227/130 |
| 7,014,089 | B2 * | 3/2006 | Ishizawa et al. | 227/130 |
| 7,225,961 | B1 * | 6/2007 | Lee | 227/130 |
| 7,293,684 | B1 * | 11/2007 | Wen et al. | 227/130 |
| 7,475,800 | B2 * | 1/2009 | Liang | 227/130 |
| 7,677,426 | B2 * | 3/2010 | Tillinghast et al. | 227/130 |

* cited by examiner

*Primary Examiner* — Scott A. Smith
(74) *Attorney, Agent, or Firm* — Chun-Ming Shih

(57) ABSTRACT

A trigger valve controlling device for a pneumatic nail gun includes a main air passageway, a valve sleeve and a main air valve opening. The valve sleeve separates the main air passageway into a front passageway, a middle chamber and a rear passageway. After hitting nails, a high pressure air in the trigger valve controlling device is capable of driving a hitting bar of the pneumatic nail gun to move upward to reset.

9 Claims, 6 Drawing Sheets

TRIGGER VALVE CONTROLLING DEVICE FOR PNEUMATIC NAIL GUN

BACKGROUND

The present invention relates to a trigger valve controlling device and, more particularly, to a trigger valve controlling device for a pneumatic nail gun, a valve sleeve of the trigger valve which can detect an opening or closing status of a top air outlet of a cylinder, and an air driving passageway for controlling high pressure air to drive a hitting bar to reset.

A pneumatic nail gun having a pneumatic power source is a type tool used to drive nails into wood or some other kind of material. Usually, a safe sliding rod is arranged on a periphery of a gun body. The safe sliding rod is used to control operation sequence of hitting nails. The gun body has a plurality of main air chambers, a cylinder, a piston slidably connected in the cylinder, a hitting bar mounted to a bottom of the piston and a trigger valve for driving the hitting bar to hit nails therein. The main air chambers are configured to receive a high pressure air and keep a pressure of the high pressure air constant. The piston separates the cylinder into a top cylinder chamber and a bottom cylinder chamber. The top cylinder chamber is intercommunicated with a top air outlet of the gun body, and the bottom cylinder chamber is intercommunicated with a bottom air outlet of the gun body.

In use, a user can push the safe sliding rod and press the trigger valve so as to shift an air driving passageway of the high pressure air in the gun body, which makes the high pressure air flow through the air driving passageway and enter into the top cylinder chamber, thereby driving the piston and a piston rod mounted to a bottom of the piston to move downward to hit nails. In the meantime, the air in the bottom cylinder chamber can be exhausted via the bottom air outlet. After that, the user can release the safe sliding rod and the trigger valve so as to shift the air driving passageway. The high pressure air in the top cylinder chamber is exhausted via the top air outlet, and the high pressure air enters into the bottom cylinder chamber, thereby driving the piston and the piston rod mounted to the bottom of the piston to move upward to reset.

Among conventional technology about driving a hitting rod to move upward to reset, such as U.S. Pat. No. 5,911,351, teaches that an air chamber having a constant volume (also known as a return air chamber) is arranged on a periphery of a cylinder. The air chamber gathers a limited high pressure air from a top cylinder chamber when a piston in the cylinder moves downward. In the meantime, when the piston moves downward, the air chamber also gathers a residual air from a bottom cylinder chamber. After a user releases a safe sliding rod, the high pressure air in the air chamber is guided to the bottom cylinder chamber, which forms a power source to drive the piston and a hitting bar to move upward to reset.

However, due to a limited volume of the air chamber, a pressure of the high pressure air in the air chamber is smaller than that of the high pressure air required to hit nails. As a result, when the piston and the hitting bar are moved upward to reset, a speed of the piston and the hitting bar is not desirable. When the piston drives the hitting bar to move downward, gathering the high pressure air from the top cylinder chamber, or gathering the air residual in the bottom cylinder chamber, will reduce a power in the cylinder for hitting nails. Therefore, an efficiency and a smoothness of hitting nails are reduced.

In order to overcome above described questions, among a more advanced technology, a valve control device is disposed between a main cylinder chamber and a bottom cylinder chamber in a gun body. The valve control device can control a right time of the high pressure air driving the piston to move upward to reset. Particularly, when releasing the trigger and the safe sliding rod, the valve control device can open an air passageway of the main cylinder chamber and the bottom cylinder chamber. The high pressure air continuously enters into the bottom cylinder chamber to drive the piston to reset. However, a structure of the valve control device is complicated with too many components, so that a larger receiving space in the gun body is required. This also makes air passageways in the gun body be complicated so that it is difficult to manufacture the gun body and a manufacturing cost is high.

BRIEF SUMMARY

The present invention provides a trigger valve controlling device for a pneumatic nail gun which can overcome the following problems of conventional technology:

1. When the piston drives the hitting bar to move downward, the air chamber having the limited volume gathers the limited high pressure air from the top cylinder chamber, or gathers the residual air from the bottom cylinder chamber, which is not of benefit to promote a speed and a stability of the piston and the hitting bar when the piston and the hitting bar move upward to reset. This also reduces a power in the cylinder, and an efficiency and a smoothness of hitting nails are reduced.
2. A valve controlling device is extra disposed in the gun body and has a complicated structure with too many components, so that a larger receiving space in the gun body is required. Thus, it is difficult to manufacture the gun body and a manufacturing cost is high.

According to the present invention, a trigger valve controlling device for a pneumatic nail gun, is disposed in a gun body which comprises a main cylinder chamber filled with a high pressure air, an upper air outlet, a hitting bar, a bottom cylinder chamber and a trigger valve, comprising:

a main air passageway formed on a periphery of the trigger valve, and being intercommunicated with the main cylinder chamber and the bottom cylinder chamber;

a valve sleeve sleeved on the periphery of the trigger valve, being located in the main air passageway, and separating the main air passageway into a front passageway intercommunicated with the main air chambers, a middle chamber and a rear passageway intercommunicated with the bottom cylinder chamber, the high pressure air in the main cylinder chamber flowing into the front passageway to compress;

a main air valve opening disposed between the front passageway and the rear passageway, the main air valve being opened and closed by the valve sleeve;

a secondary air passageway intercommunicated with the main cylinder chamber and the middle chamber, guiding the high pressure air to enter into the middle chamber to compress, the valve sleeve being pushed the high pressure air in the middle chamber to move linearly downward, thereby closing the main air valve opening, the trigger valve being released after the nail gun hitting nails and before the hitting bar being reset, the high pressure air in the secondary air passageway and the middle chamber flowing to the upper air outlet, so that the valve sleeve is driven by the high pressure air in the front passageway to linearly move upward, thereby opening the main air valve opening, the high pressure air in the front passageway entering into the bottom cylinder chamber via the rear passageway, so as to drive the hitting bar to move upward to reset.

The trigger valve controlling device of the present invention has the following advantages:

1. A valve sleeve disposed in a single main air passageway controls the right time of a high pressure air with a constant pressure flowing towards a bottom cylinder chamber, which is of benefit to promote a speed and a stability of a piston and a hitting bar when the piston and the hitting bar move upward to reset. Furthermore, this does not affect a power of the high pressure air in the cylinder used for driving the piston and the hitting bar to move downward to hit nails, thereby improving an efficiency and a smoothness of hitting nails.

2. A single valve sleeve is arranged on the trigger valve, the valve sleeve has a small volume and a simple structure so that the trigger valve is sensitive to be driven by the high pressure air.

3. The valve sleeve and the trigger valve constitute a single unit, which can save a receiving space of the gun body and reduce a complexity of manufacturing air passageways in the gun body, so as to reduce a manufacturing cost.

In the trigger valve controlling device of the present invention, the trigger valve comprises a valve body and the valve rod, the valve sleeve is sleeved on a periphery of the valve body, the valve body has a guiding passageway intercommunicated with the main cylinder chamber and atmosphere, a trigger air channel for controlling hitting nails in the gun body is intercommunicated with the guiding passageway, the valve rod is slidably disposed in the guiding passageway and is configured to shift the trigger air channel to intercommunicate the main cylinder chamber or atmosphere.

An upper ring surface is formed on the top of the valve sleeve and is exposed in the middle chamber, the valve sleeve, together with the upper ring surface, is capable of being pushed by the high pressure air in the middle chamber to move linearly downward, the lower ring surface is formed on the outer wall of the valve sleeve and is exposed in the front passageway, the valve sleeve, together with the lower ring surface, is capable of being pushed by the high pressure air in the front passageway to move linearly upward.

A seal ring cushion is sleeved on a periphery of the valve body and is disposed between the front passageway and the rear passageway, the main air valve opening is formed between an outer wall of the valve body and the seal ring cushion and is located opposite to a bottom portion of the valve sleeve. The seal ring cushion defines a plurality of air guiding holes intercommunicated with the main air valve opening and the rear passageway.

The valve rod has a block portion formed on a top thereof, the block portion is driven by the high pressure air and is exposed in the main cylinder chamber, the valve rod has a push portion formed on a bottom thereof, the push portion is touchable by the trigger and is exposed out of the gun body. The block portion defines a plurality of guiding grooves on a periphery thereof.

The main air passageway is disposed in the bottom of the gun body adjacent to the safe sliding rod. As such, the main air passageway is adjacent to an outer wall of the gun body, which can reduce a complexity of manufacturing the main air passageways in the gun body.

An area of the upper ring surface is larger than that of the lower ring surface. As such, before exhausting the high pressure air in the secondary air passageway and the middle chamber via the upper air outlet, the valve sleeve can be pushed by the high pressure air in the middle chamber, thereby closing the main air valve opening.

BRIEF DESCRIPTION OF THE DRAWINGS

These and other features and advantages of the various embodiments disclosed herein will be better understood with respect to the following description and drawings, in which like numbers refer to like parts throughout, and in which.

Other objectives, features and advantages of the present invention will be further understood from the further technological features disclosed by the embodiments of the present invention wherein there are shown and described preferred embodiments of this invention, simply by way of illustration of modes best suited to carry out the invention.

DETAILED DESCRIPTION

Figure 1:
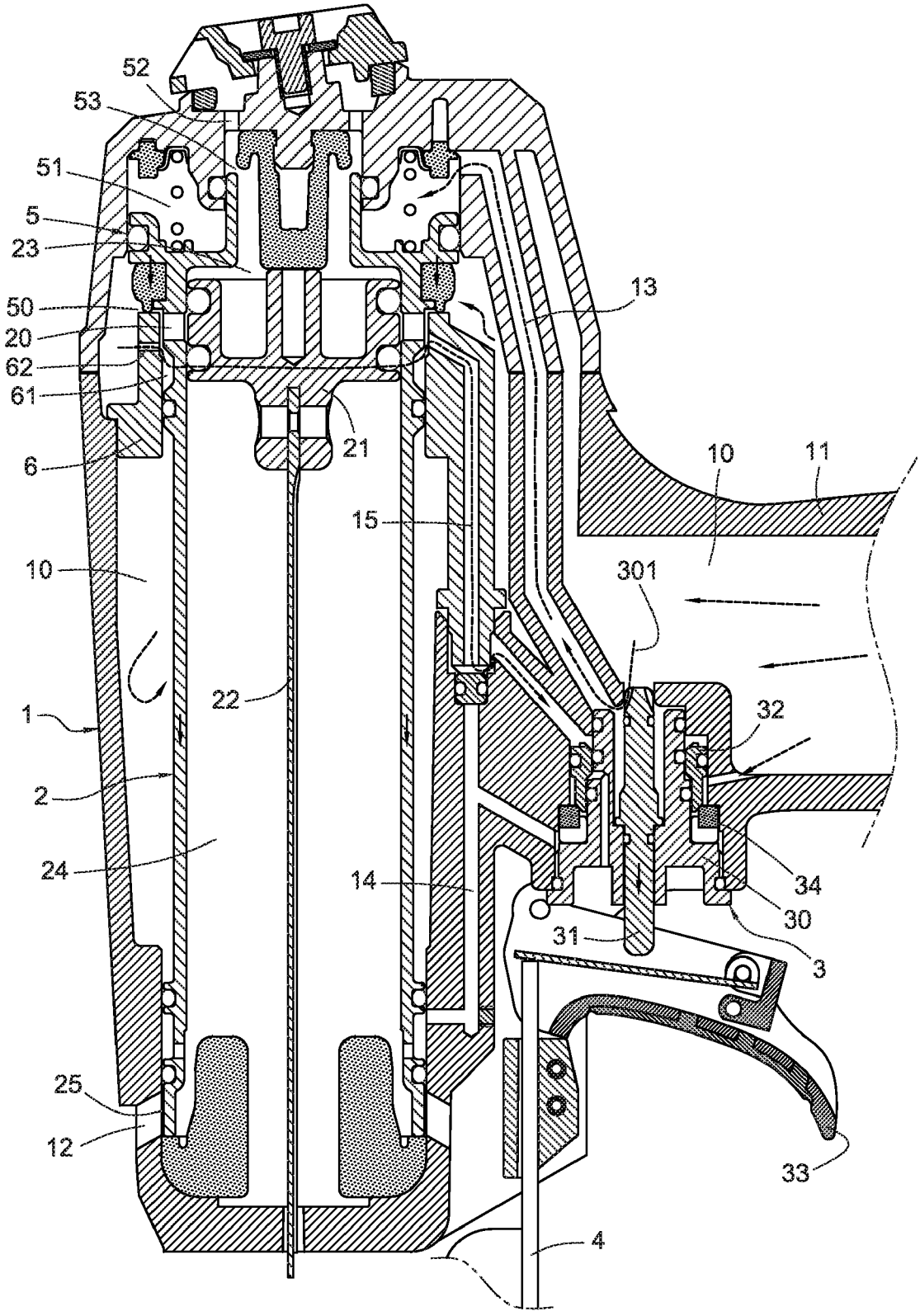
FIG. 1 is a cutaway view of a trigger valve controlling device for a pneumatic nail gun in accordance with the present invention.

FIG. 1 shows a cutaway view of a trigger valve controlling device for a pneumatic nail gun in accordance with the present invention. The trigger valve controlling device for a pneumatic nail gun is disposed in a gun body 1 of the pneumatic nail gun. A cylinder 2 is disposed in the gun body 1, and a piston 21 is slidably connected to the cylinder 2. A bottom of the piston 21 is connected to a hitting bar 22. The piston 21 separates the cylinder 2 into a top cylinder chamber 23 and a bottom cylinder chamber 24. A plurality of main air chambers 10 are formed in the gun body 1. The main air chambers 10 are filled with a high pressure air and are intercommunicated with each other. The main air chambers 10 are disposed between a periphery of the cylinder 2 and a handle 11, and are configured to receive the high pressure air continuously flowing from a rear of the handle 11.

The gun body 1 has a trigger valve 3 adjacent to the handle 11. The trigger valve 3 is intercommunicated with the main air chambers 10. A safe sliding rod 4 is slidably connected to an outer wall of the gun body 1. A head valve 5 is disposed above the cylinder 2. A ring sleeve 6 is sleeved on a periphery of a top of the cylinder 2.

A reservoir 51 (as shown in FIG. 1) is formed between an inner wall of the top of the gun body 1 and the head valve 5. A trigger air channel 13 is formed in the gun body 1 and is intercommunicated with the reservoir 51. An air valve opening 50 intercommunicated with the main air chambers 10 is formed between a periphery of the head valve 5 and a top of the ring sleeve 6 (also referring to FIG. 3). A plurality of through holes 20 intercommunicated with the top cylinder chamber 23 and the air valve opening 50 are arranged on the top of the cylinder 2 and surround the top of the cylinder 2. A ring groove 61 intercommunicated with the through holes 20 and the air valve opening 50 is formed between the ring sleeve 6 and an outer wall of the top of the cylinder 2. A plurality of air inlet holes 62 intercommunicated with the main air chambers 10 and the ring groove 61 is formed on the ring sleeve 6. The piston 21 is able to prevent the through holes 20 from intercommunicating with the top cylinder chamber 23, the air valve opening 50 and the ring groove 61.

An upper air outlet 52 intercommunicated with the top cylinder chamber 23 and atmosphere is formed on the top of the gun body 1. An upper air valve opening 53 is formed between the top of the head valve 5 and an inner wall of the top of the gun body 1, and is configured for switching the upper air outlet 52 on or off. A plurality of lower air outlets 12 intercommunicated with the bottom cylinder chamber 24 and atmosphere are formed on a bottom of the gun body 1. A lower air valve opening 25 is formed between the bottom of the cylinder 2 and the inner wall of the bottom of the gun body 1, and is configured for switching the lower air outlets 12 on or off.

Figure 2:
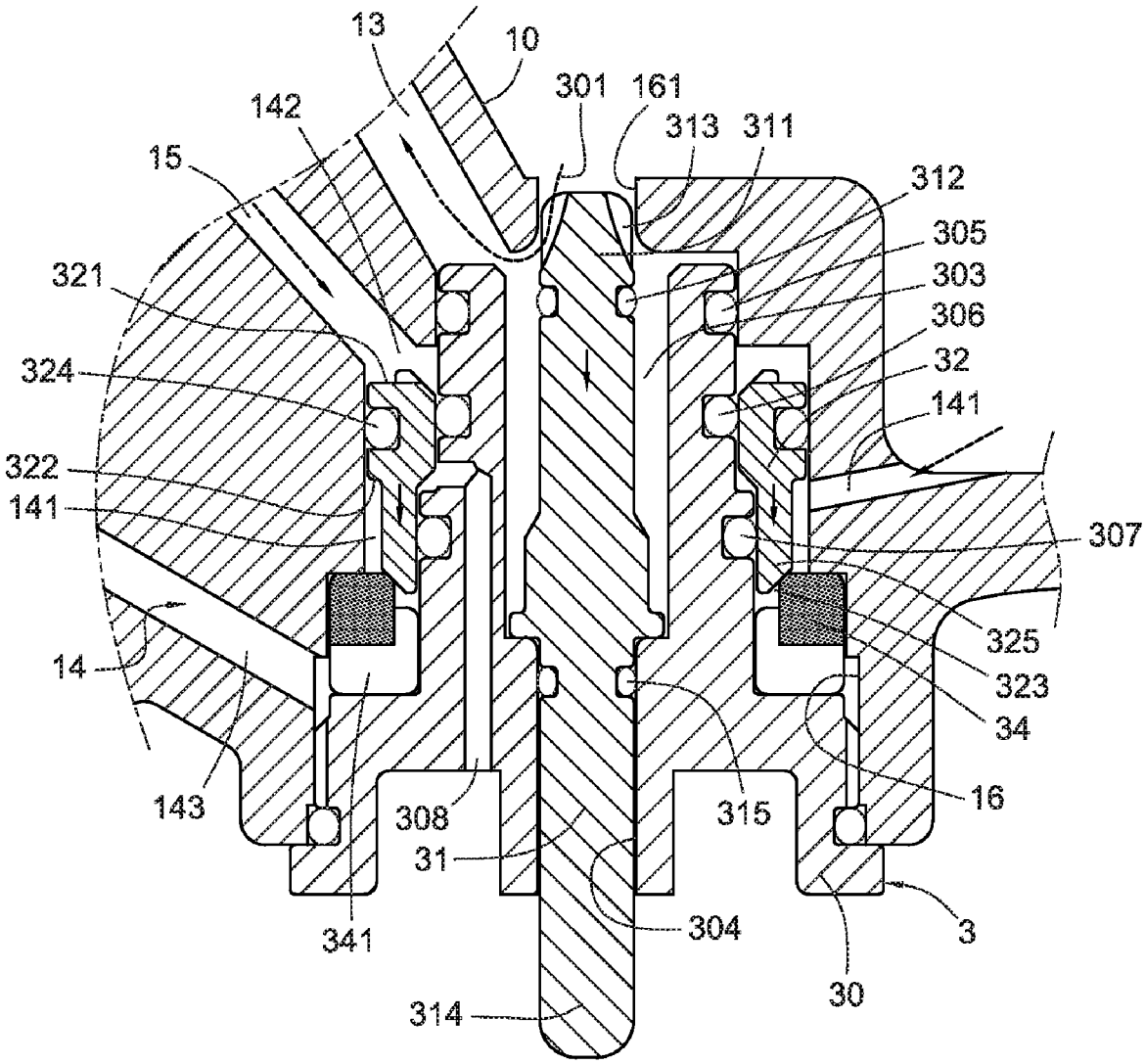
FIG. 2 is a partial enlarged view of FIG. 1.

The trigger valve 3 has a valve rod 31 which is slidable (as shown in FIG. 1 and FIG. 2). A trigger 33 is pivotably mounted to a side of the gun body 1. When pressing the trigger 33 or releasing the valve rod 31, an air inlet channel 301 intercommunicated with the main air chambers 10 and the trigger air channel 13, and an air outlet channel 302 intercommunicated with the trigger air channel 13 and atmosphere are formed in the trigger valve 3 (also referring to FIG. 4).

It should be pointed out that, the above description of the cylinder 2, the trigger valve 3, the safe sliding rod 4 and the head valve 5 is given by way of example, and not limitation. In other words, the nail gun used to hit nail which includes a movable or a fixed cylinder, a trigger valve, a safe sliding rod and a head valve, could also be applied in the present invention.

As described above, the trigger valve controlling device of the present invention includes a valve sleeve 32 of the trigger valve 3, a main air passageway 14, a main air valve opening 323, a secondary air passageway 15, an upper ring surface 321 and a lower ring surface 322 (as shown in FIG. 1 and FIG. 2). The gun body 1 has a receiving groove 16 adjacent to the handle 11. An air feed orifice 161 intercommunicated with the main air chambers 10 is formed on a top of the receiving groove 16. The main air passageway 14 is disposed in the bottom of the gun body 1 adjacent to the safe sliding rod 4. As such, the main air passageway 14 is adjacent to an outer wall of the gun body 1, which can reduce a complexity of manufacturing the main air passageways 14 in the gun body. The main air passageway 14 is passed through the receiving groove 16.

The receiving groove 16 is respectively intercommunicated with the trigger air channel 13 and the secondary air passageway 15. The trigger valve 3 is fixed in the receiving groove 16. The main air passageway 14 is formed on periphery of the trigger air channel 3. The main air passageway 14 is intercommunicated with the main air chambers 10 and the bottom cylinder chamber 24. The valve sleeve 32 is sleeved on a periphery of the trigger valve 3. The valve sleeve 32 is located in the main air passageway 14, and separates the main air passageway 14 into a front passageway 141 intercommunicated with the main air chambers 10, a middle chamber 142 and a rear passageway 143 intercommunicated with the bottom cylinder chamber 24. The high pressure air of the main air chambers 10 can enter into the front passageway 141 to compress.

In this embodiment, the trigger valve 3 includes a valve body 30 and the valve rod 31 (as shown in FIG. 1 and FIG. 2). A first seal ring 305, a second seal ring 306 and a third seal ring 307 is sleeved on an outer surface of the valve body 30 from top to bottom. The main air passageway 14 is formed on a periphery of the valve body 30. The valve sleeve 32 can be sleeved on a periphery of the valve body 30, and an inner wall of the valve sleeve 32 is in touch with the second and third seal ring 306, 307. A seal ring 324 is sleeved on a periphery of the valve sleeve 32. The valve sleeve 32 is in touch with an inner wall of the receiving groove 16. Furthermore, an air passing hole 308 is formed on a periphery of the valve body 30, and is located between the second seal ring 306 and the third seal ring 307. The air passing hole 308 is communicated with atmosphere, so that the valve sleeve 32 can be driven to move upward or downward. The valve body 30 has a guiding passageway 303 intercommunicated with the main air chambers 10, the air feed orifice 161 and atmosphere. The trigger air channel 13 is communicated with a top of the guiding passageway 303. A guiding hole 304 intercommunicated with atmosphere is formed under a bottom of the guiding passageway 303.

The valve rod 31 is slidably disposed in the air feed orifice 161, the guiding passageway 303 and the guiding hole 304. The valve rod 31 has a block portion 311 formed on a top thereof. The block portion 311 is driven by the high pressure air, and is exposed in the main air chambers 10 via the air feed orifice 161. An upper seal ring 312 is sleeved on the block portion 311, for sealing the air feed orifice 161. The block portion 311 defines a plurality of guiding grooves 313 on a periphery thereof. The guiding grooves 313 are disposed above the upper seal ring 312. The valve rod 31 has a push portion 314 formed on a bottom thereof. The push portion 314 is touchable by the trigger 33, and is exposed out of the gun body 1 via the guiding hole 304. A lower seal ring 315 is sleeved on a middle portion of the valve rod 31, for sealing the guiding hole 304.

The high pressure air flowing through the main air chambers 10 actuates the block portion 311 to move downward (as shown in FIG. 2). The upper seal ring 312, together with the valve rod 31, downwardly moves to the guiding passageway 303, which opens to the air feed orifice 161. The lower seal ring 315, together with the valve rod 31, moves downward and seals the guiding hole 304, thereby shifting the main air chambers to intercommunicate with the trigger air channel 13 via the air inlet channel 301. In the meantime, a discharge of the high pressure air entered into the trigger air channel 13 is also promoted via the guiding grooves 313.

Figure 3:
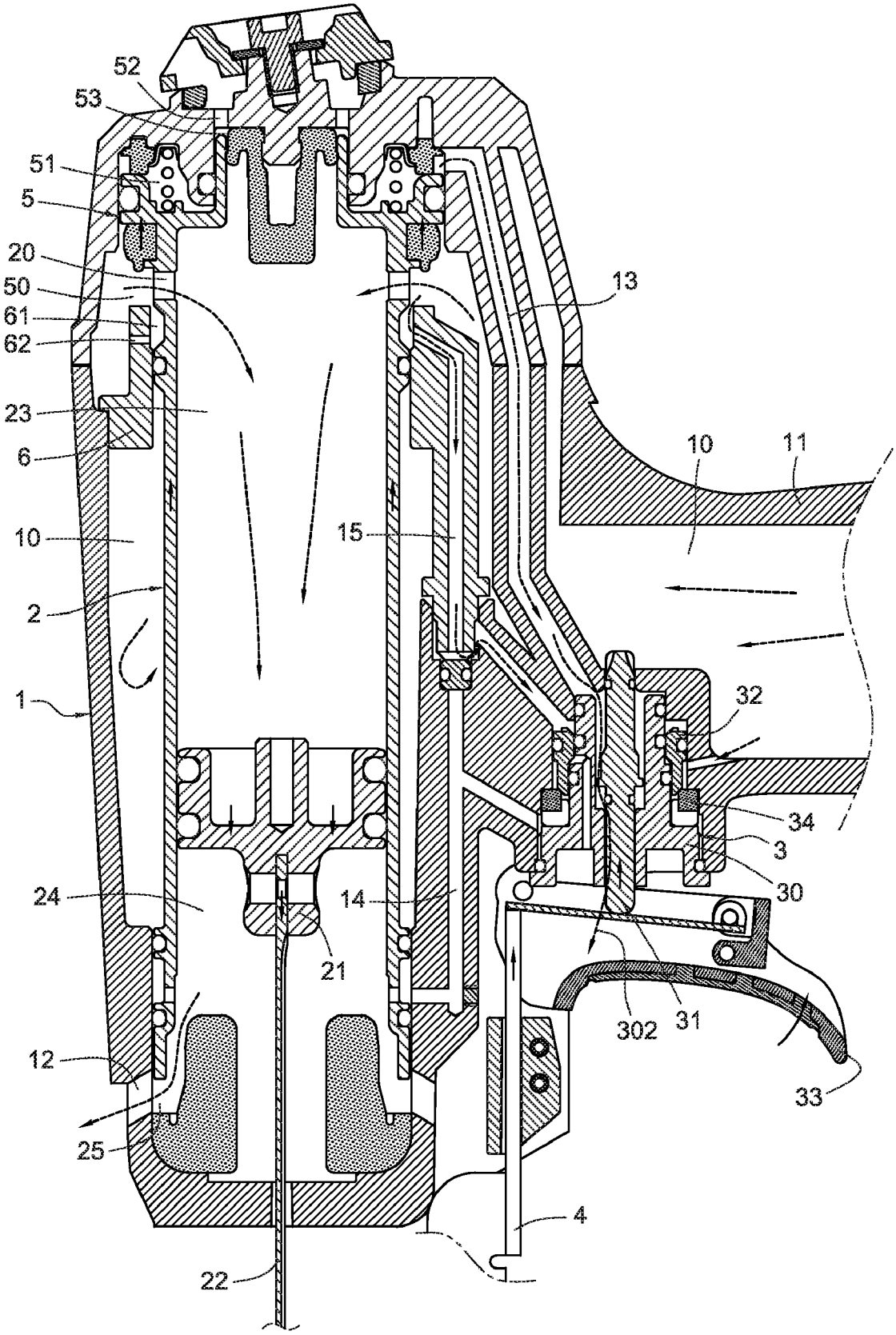
FIG. 3 is a working status view of FIG. 1.
Figure 4:
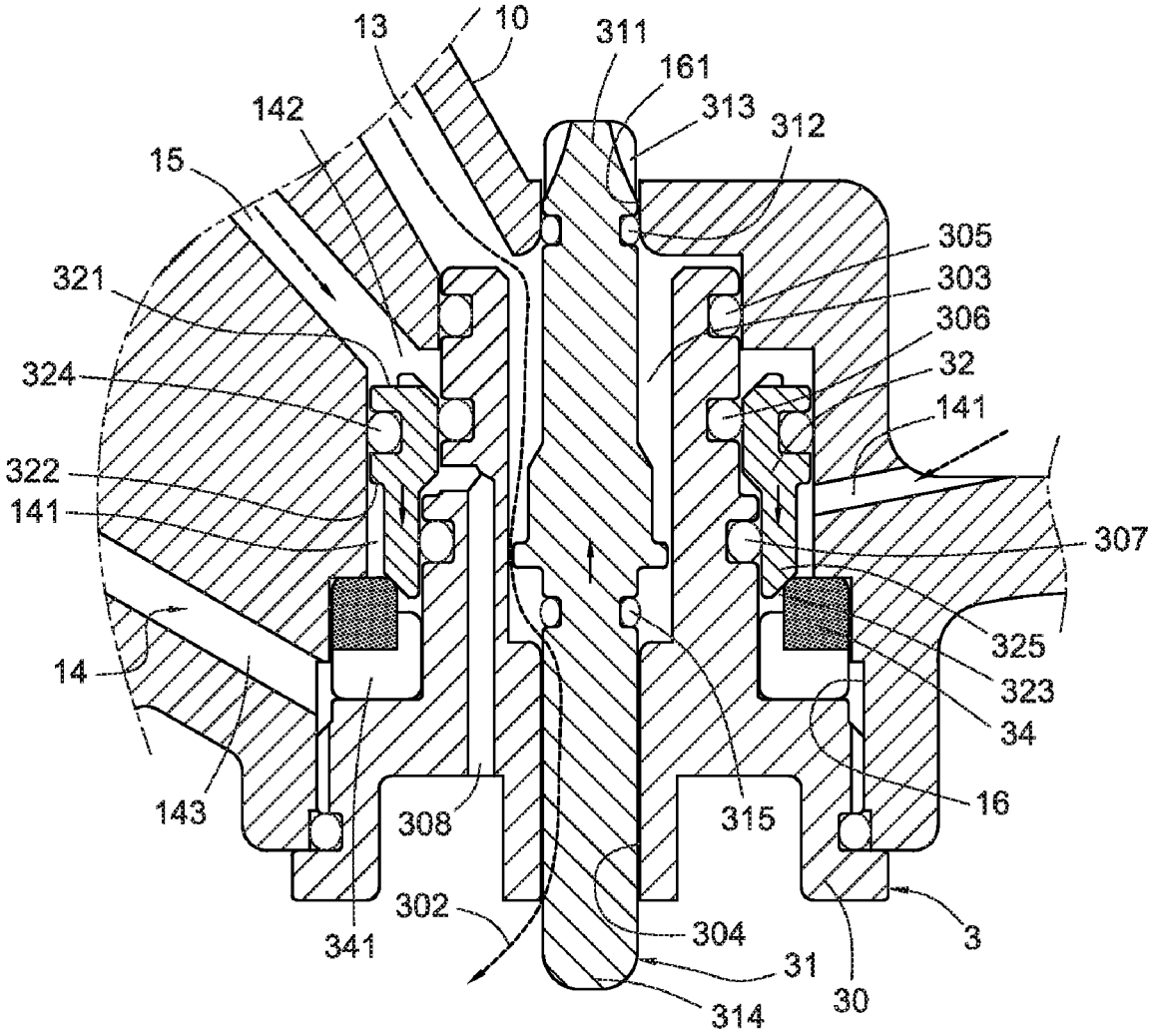
FIG. 4 is a partial enlarged view of FIG. 3.

The push portion 314 is upwardly pushed by the trigger 33 (as shown in FIG. 3 and FIG. 4). The upper seal ring 312, together with the valve rod 31, moves upward and seals the air feed orifice 161. The lower seal ring 315, together with the valve rod 31, upwardly moves to the guiding passageway 303, so as to open the guiding hole 304 and shift the trigger air channel 13 to intercommunicate with atmosphere via the air outlet channel 302.

Figure 6:
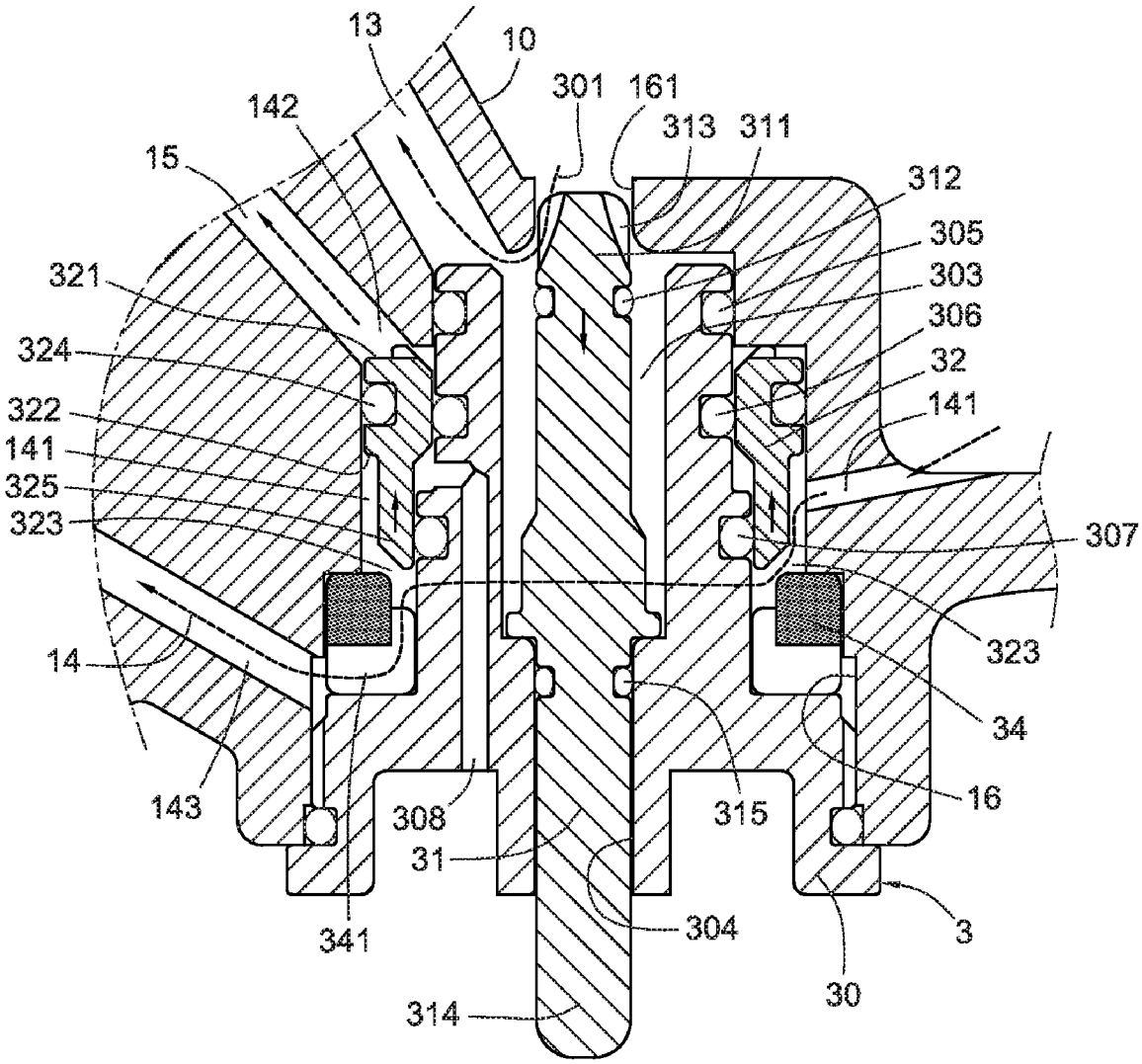
FIG. 6 is a partial enlarged view of FIG. 5.

The main air valve opening 323 is disposed between the front passageway 141 and the rear passageway 143 (referring to FIG. 2 and FIG. 6). A seal ring cushion 34 is sleeved on a periphery of the valve body 30, and is disposed between the front passageway 141 and the rear passageway 143. The main air valve opening 323 is actually formed between an outer wall of the valve body 30 and the seal ring cushion 34, and is located opposite to a bottom portion 325 of the valve sleeve 32. The bottom portion 325 of the valve sleeve 32 can move upward and detach from a position between the outer wall of the valve body 30 and the seal ring cushion 34, so as to open the main air valve opening 323. The bottom portion 325 of the valve sleeve 32 can also move downward to plug a slit between the outer wall of the valve body 30 and the seal ring cushion 34, so as to close the main air valve opening 323. In the meantime, a plurality of air guiding holes 341 are formed between an inner wall and an outer wall of the seal ring cushion 34. The air guiding holes 341 are intercommunicated with the main air valve opening 323 and the rear passageway 143.

The secondary air passageway 15 is intercommunicated with the main air chambers 10, air inlet holes 62, a ring groove 61, the through hole 20 and the middle chamber 142 (as shown in FIG. 1 and FIG. 2). The upper air outlet 52 is intercommunicated with the secondary air passageway 15 via the upper air valve opening 53, the top cylinder chamber 23, the through hole 20 and the ring groove 61. The first seal ring 305 is disposed between the trigger air channel 13, the secondary air passageway 15, and the valve body 30. When the piston 21 is located in the top of the cylinder 2, the high pressure air is prevented from flowing into the top cylinder chamber 23, the upper air valve opening 53 and the upper air outlet 52 via the through hole 20. Thus, the secondary air passageway 15 can guide the high pressure air into the main air chambers 10 to compress.

Figure 5:
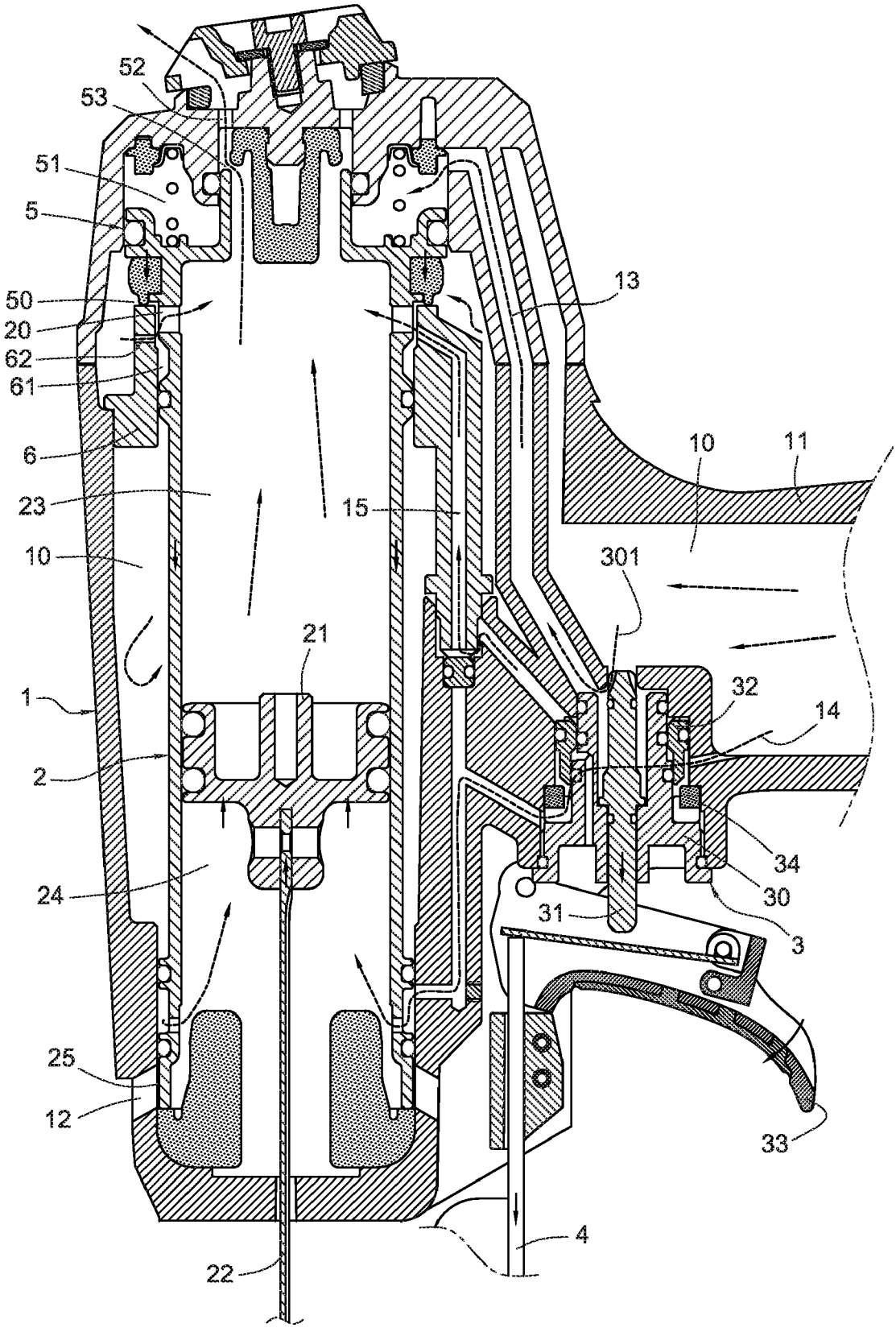
FIG. 5 is a working status view of FIG. 3.

When the valve rod 31 of the trigger valve 3 is released after hitting nails and before the hitting bar 22 is reset (as shown in FIG. 5), the upper air valve opening 53 is able to open the upper air outlet 52. In the meantime, the piston 21 does not reset to the top of the cylinder 2, and the high pressure air in the ring groove 61 can be allowed to flow into the top cylinder chamber 23, the upper air valve opening 53 and the upper air outlet 52 via the through hole 20, so as to exhaust the high pressure air in the secondary air passageway 15 and the middle chamber 142.

The upper ring surface 321 is formed on the top of the valve sleeve 32, and is exposed in the middle chamber 142 (as shown in FIG. 2). The lower ring surface 322 is formed on the outer wall of the valve sleeve 32, and is exposed in the front passageway 141. An area of the upper ring surface 321 is larger than that of the lower ring surface 322. Therefore, before exhausting the high pressure air in the secondary air passageway 15 and the middle chamber 142 via the upper air outlet 52, the valve sleeve 32, together with the upper ring surface 321, can be pushed by the high pressure air in the middle chamber 142 to move linearly downward, thereby closing the main air valve opening 323. When exhausting the high pressure air in the secondary air passageway 15 and the middle chamber 142 via the upper air outlet 52 (as shown in FIG. 5 and FIG. 6), the valve sleeve 32, together with the lower ring surface 322, can be pushed by the high pressure air in the front passageway 141 to move linearly upward, thereby opening the main air valve opening 323. As a result, the high pressure air in the front passageway 141 enters into the bottom cylinder chamber 24 after flowing through the main air valve opening 323, the air guiding holes 341 and the rear passageway 143, and drives the hitting bar 22 to move upward to reset.

According to the above-mentioned configuration, when a user does not push the safe sliding rod to move upward and does not press the trigger 33 (as shown in FIG. 1), the high pressure air in the main air chambers 10 downwardly drives the block portion 311 (as shown in FIG. 2). Thus, the upper seal ring 312, together with valve rod 31, is downwardly moved into the guiding passageway 303 so as to open the air feed orifice 161. The lower seal ring 315, together with the valve rod 31, is downwardly moved to plug the guiding hole 304, thereby opening the air inlet channel 301 and closing the air outlet channel 302. The high pressure air in the main air chambers 10 enters into the reservoir 51 to compress after flowing through the air inlet channel 301 and the trigger air channel 13. The head valve 5 and the cylinder is pushed to move downward so as to open the upper air valve opening 53 and the upper air outlet 52 and close the air valve opening 50, the lower air valve opening 25 and the lower air outlets 12. The piston 21 keeps in the top of the cylinder 2 and the head valve 5, which prevents the through hole 20 from intercommunicating with the top cylinder chamber 23, the air valve opening 50 and the ring groove 61. As a result, the high pressure air in the main air chambers 10 flows through the air inlet holes 62 and the ring groove 61 into the secondary air passageway 15 and the middle chamber 142 to compress. The valve sleeve 32, together with the upper ring surface 321, is driven by the high pressure air in the middle chamber 142 to move linearly downward, which makes the bottom portion 325 of the valve sleeve 32 insert between the out wall of the valve body 30 and the seal ring cushion 34, thereby closing the main air valve opening 323. Thus, the high pressure air in the main air chambers 10 is prevented from flowing from the front passageway 141 to the rear passageway 143.

When the user pushes the safe sliding rod 4 to move upward and presses the trigger 33 (as shown in FIG. 3), the trigger 33 will push the valve rod 31 to move upward (as shown in FIG. 4). The upper seal ring 312, together with the valve rod 31, moves upward and plugs the air feed orifice 161. The lower seal ring 315, together with the valve rod 31, moves upward to the guiding passageway 303 so as to open the guiding hole 304 and close the air inlet channel 301. In the meantime, the air outlet channel 302 is opened, and the high pressure air in the reservoir 51 is exhausted to atmosphere after flowing through the trigger air channel 13 and the air outlet channel 302. This makes the head valve 5 and the cylinder 2 be driven to move upward by the high pressure air in the main air chambers 10 disposed on the periphery of the cylinder 2, thereby closing the upper air valve opening 53 and the upper air outlet 52 and opening the air valve opening 50, the lower air valve opening 25 and the lower air outlets 12. The high pressure air in the main air chambers 10 flows through the air valve opening 50 and the through hole 20 and enters into the top cylinder chamber 23, so as to drive the hitting bar 22 by the piston 21 to move downward to hit nails. The high pressure air in the bottom cylinder chamber 24 flows through the lower air valve opening 25 and the lower air outlets 12 to exhaust to atmosphere. In the meantime, because the cylinder 2 is moved upward and closes the upper air valve opening 53 and the upper air outlet 52, the high pressure air in the main air chambers 10 can directly flow through the ring groove 61 and enter into the secondary air passageway 15 and the middle chamber 142 to compress.

After hitting a nail, when the user releases the trigger 33 (as shown in FIG. 5), the trigger 33 will release the valve rod 31. The high pressure air in the main air chambers 10 drives the valve rod 31 to move downward again (as shown in FIG. 6), so as to open the air inlet channel 301 and close the air outlet channel 302. The high pressure air in the main air chambers 10 again flows through the air inlet channel 301 and the trigger air channel 13 and enters into reservoir 51 to compress. The head valve 5 and the cylinder 2 are driven to move downward, thereby closing the air valve opening 50, the lower air valve opening 25 and the lower air outlets 12 and opening the upper air valve opening 53 and the upper air outlet 52. As a result, the high pressure air in the top cylinder chamber 23 flows through the upper air outlet 52 to exhaust to atmosphere. In the meantime, the high pressure air in the middle chamber 142 and the secondary air passageway 15 flows through the through hole 20, the top cylinder chamber 23, the upper air valve opening 53 and the upper air outlet 52 to exhaust to atmosphere. Thus, the valve sleeve 32, together with the lower ring surface 322, is driven by the high pressure air in the front passageway 141 to linearly move upward, thereby opening the main air valve opening 323. The high pressure air in the front passageway 141 flows through the main air valve opening 323, the air guiding holes 341 and the rear passageway 143 to enter into the bottom cylinder chamber 24, so as to drive the hitting bar 22 to move upward to reset.

It is believed that, the present invention has sufficiently taught necessary technical features which can be employed in industry. Particularly, the valve sleeve 32 disposed in the single main air passageway 14 controls the right time of the high pressure air with a constant pressure flowing towards the bottom cylinder chamber 24, which is of benefit to promote a speed and a stability of the piston 21 and the hitting bar 22 when the piston 21 and the hitting bar 22 move upward to reset. Furthermore, this does not affect a power of the high pressure air in the cylinder 2 used for driving the piston 21 and the hitting bar 22 to move downward to hit nails, thereby improving an efficiency and a smoothness of hitting nails. Additionally, the single valve sleeve 32 is arranged on the trigger valve 3, the valve sleeve 3 has a small volume and a simple structure so that the trigger valve 3 is sensitive to be driven by the high pressure air. Furthermore, the valve sleeve 32 and the trigger valve 3 constitute a single unit, which can save a receiving space of the gun body 1 and reduce a complexity of manufacturing air passageways in the gun body 1, so as to reduce a manufacturing cost.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A trigger valve controlling device for a pneumatic nail gun, is disposed in a gun body which comprises a main cylinder chamber filled with a high pressure air, an upper air outlet, a hitting bar, a bottom cylinder chamber and a trigger valve, comprising:

a main air passageway formed on a periphery of the trigger valve, and being intercommunicated with the main cylinder chamber and the bottom cylinder chamber;

a valve sleeve sleeved on the periphery of the trigger valve, being located in the main air passageway, and separating the main air passageway into a front passageway intercommunicated with the main air chambers, a middle chamber and a rear passageway intercommunicated with the bottom cylinder chamber, the high pressure air in the main cylinder chamber flowing into the front passageway to compress;

a main air valve opening disposed between the front passageway and the rear passageway, the main air valve being opened and closed by the valve sleeve;

a secondary air passageway intercommunicated with the main cylinder chamber and the middle chamber, guiding the high pressure air to enter into the middle chamber to compress, the valve sleeve being pushed the high pressure air in the middle chamber to move linearly downward, thereby closing the main air valve opening, the trigger valve being released after the nail gun hitting nails and before the hitting bar being reset, the high pressure air in the secondary air passageway and the middle chamber flowing to the upper air outlet, so that the valve sleeve is driven by the high pressure air in the front passageway to linearly move upward, thereby opening the main air valve opening, the high pressure air in the front passageway entering into the bottom cylinder chamber via the rear passageway, so as to drive the hitting bar to move upward to reset.

2. The trigger valve controlling device according to claim 1, wherein the trigger valve comprises a valve body and the valve rod, the valve sleeve is sleeved on a periphery of the valve body, the valve body has a guiding passageway intercommunicated with the main cylinder chamber and atmosphere, a trigger air channel for controlling hitting nails in the gun body is intercommunicated with the guiding passageway, the valve rod is slidably disposed in the guiding passageway and is configured to shift the trigger air channel to intercommunicate the main cylinder chamber or atmosphere.

3. The trigger valve controlling device according to claim 2, wherein a seal ring cushion is sleeved on a periphery of the valve body and is disposed between the front passageway and the rear passageway, the main air valve opening is formed between an outer wall of the valve body and the seal ring cushion and is located opposite to a bottom portion of the valve sleeve.

4. The trigger valve controlling device according to claim 3, wherein the seal ring cushion defines a plurality of air guiding holes intercommunicated with the main air valve opening and the rear passageway.

5. The trigger valve controlling device according to claim 2, wherein the valve rod has a block portion formed on a top thereof, the block portion is driven by the high pressure air and is exposed in the main cylinder chamber, the valve rod has a push portion formed on a bottom thereof, the push portion is touchable by the trigger and is exposed out of the gun body.

6. The trigger valve controlling device according to claim 5, wherein the block portion defines a plurality of guiding grooves on a periphery thereof.

7. The trigger valve controlling device according to claim 1, wherein an upper ring surface is formed on the top of the valve sleeve and is exposed in the middle chamber, the valve sleeve, together with the upper ring surface, is capable of being pushed by the high pressure air in the middle chamber to move linearly downward, the lower ring surface is formed on the outer wall of the valve sleeve and is exposed in the front passageway, the valve sleeve, together with the lower ring surface, is capable of being pushed by the high pressure air in the front passageway to move linearly upward.

8. The trigger valve controlling device according to claim 7, wherein an area of the upper ring surface is larger than that of the lower ring surface.

9. The trigger valve controlling device according to claim 1, wherein the main air passageway is disposed in the bottom of the gun body adjacent to the safe sliding rod.

* * * * *